United States Patent [19]

Fehrer

[11] Patent Number: 4,953,349

[45] Date of Patent: Sep. 4, 1990

[54] APPARATUS FOR MAKING A YARN

[76] Inventor: Ernst Fehrer, Auf der Gugl 28, A-4020 Linz, Austria

[21] Appl. No.: 403,706

[22] Filed: Sep. 6, 1989

[30] Foreign Application Priority Data

| | | | |
|---|---|---|---|
| Sep. 29, 1988 | [AT] | Austria | 2403/88 |
| Nov. 29, 1988 | [AT] | Austria | 2928/88 |
| Dec. 23, 1988 | [AT] | Austria | 3142/88 |

[51] Int. Cl.[5] ..... D01H 5/18; D01H 5/32; D01H 5/70; D01H 5/74

[52] U.S. Cl. ..... 57/315; 19/236; 19/263; 19/288; 57/352

[58] Field of Search ..... 57/315, 304, 305, 352, 57/350, 6, 12; 19/236, 244, 248, 258, 263, 264, 288, 291

[56] References Cited

U.S. PATENT DOCUMENTS

| | | | |
|---|---|---|---|
| 3,090,081 | 5/1963 | Klein | 19/288 |
| 3,122,794 | 3/1964 | Klein | 19/288 |

FOREIGN PATENT DOCUMENTS 1178749 9/1964 Fed. Rep. of Germany .

*Primary Examiner*—John Petrakes
*Attorney, Agent, or Firm*—Kurt Kelman

[57] ABSTRACT

An apparatus for making a yarn consists of at least one ring spinning mechanism and a drawing mechanism, which precedes the ring spinning mechanism and defines at least one draft path for drawing a fibrous roving and includes two delivery rollers defining a clamping nip for the drawn roving, wherein one of said delivery rollers constitutes behind the clamping nip a guiding surface for deflecting the drawn roving. In order to increase the strength of the yarn, it is proposed that the delivery roller which constitutes the guiding surface for deflecting the roving constitutes at least near the delivery end of the guiding surface a slideway for guiding the roving transversely to its axis as the roving is twisted between the ring spinning mechanism and the drawing mechanism.

2 Claims, 3 Drawing Sheets

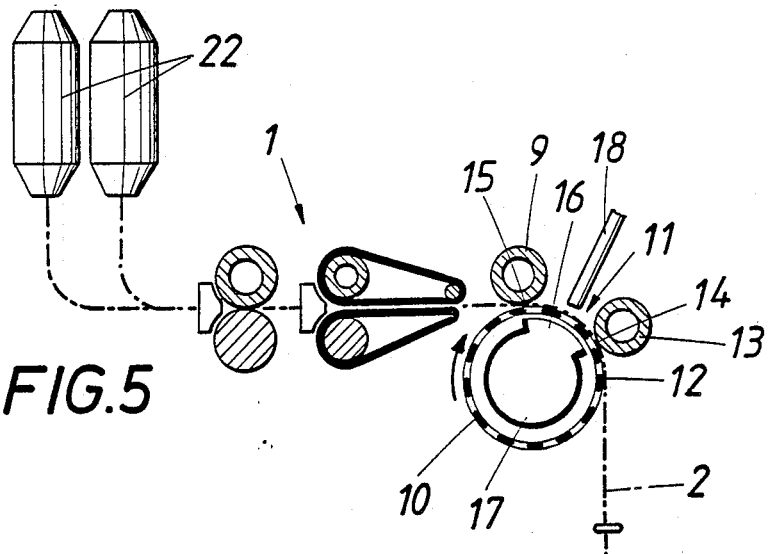
FIG.5
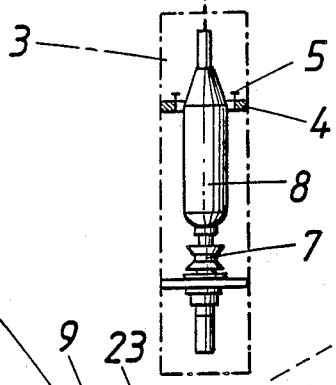
FIG.6
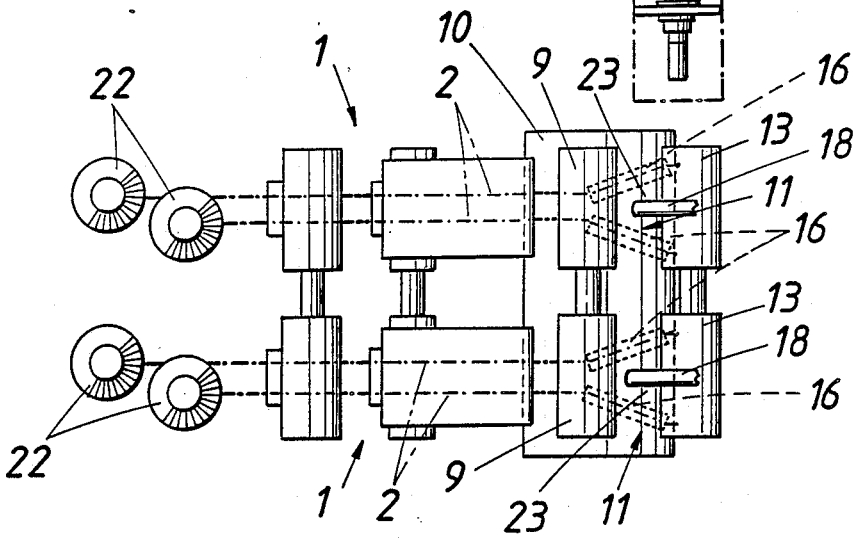

APPARATUS FOR MAKING A YARN

BACKGROUND OF THE INVENTION

1. Field of the Invention

This invention relates to an apparatus for making a yarn, comprising at least one ring spinning mechanism and a drawing mechanism, which precedes the ring spinning mechanism and defines at least one draft path for drawing a fibrous roving and includes two delivery rollers defining a clamping nip for the drawn roving, wherein one of said delivery rollers constitutes behind the clamping nip a guiding surface for deflecting the drawn roving.

2. Description of the Prior Art

The strength of the yarn which is made by known ring spinning mechanisms will essentially depend on the twist which is imparted to the drawn roving by the traveler of the ring spinning mechanism. But as the speed of the traveler of a ring spinning mechanism cannot be increased as desired, there is a restriction regarding the twist which can be imparted to the yarn, particularly if the yarn is withdrawn at high speed.

In an attempt to provide a suitably compacted roving so that the guidance of the fibers of the drawn roving will be improved, it has been proposed (DE-A-1,178,749) to provide one of the delivery rollers of the drawing frame with grooves having the shape of an arrowhead or arc and to provide adjacent to said grooves a suction zone so that the fibers are moved toward each other by means of the grooves of the delivery roller and with the assistance of the stream of sucked air in the suction zone and the width of the roving strip is thus reduced. But the fibers cannot be moved toward each other as described unless the fibers move in the feeding direction relative to the grooved delivery roller. The required transverse force can be exerted only on those fibers which with their leading ends have already reached the grooved delivery roller of the drawing frame and which have not yet been gripped in the clamping nip between the delivery rollers. For this reason the roving as a whole is compacted only to a comparatively low degree particularly because the width of the roving will be increased by the clamping nip between the delivery rollers, which define the high-draft field of the drawing frame.

SUMMARY OF THE INVENTION

For this reason it is an object of the invention to increase the spinning rate within the limits imposed by the means for driving the bobbin whereas a loss of strength need not be feared.

That object is accomplished in accordance with the invention in that the delivery roller which constitutes the guiding surface for deflecting the roving constitutes at least near the delivery end of the guiding surface a slideway for guiding the roving transversely to its axis as the roving is twisted between the ring spinning mechanism and the drawing frame.

Because that delivery roller of the drawing frame which constitutes the guiding surface constitutes a slideway for guiding the drawn roving transversely to its axis, a twist can be imparted to the roving by the traveler of the ring spinning mechanism as far as to the region of the guiding surface so that the fiber ends which inevitably project like bristles from the fibrous structure will consecutively be caused by the twisting of the roving to move against the slideway and to be urged against the roving transversely to its axis. As a result, the protruding fiber ends will be wound around the roving so that a yarn having a higher strength will necessarily be made under given spinning conditions. That delivery roller which constitutes the guiding surface affords the additional advantage that the roving which wraps that delivery roller will automatically be urged against the sliding surface whereas the resistance to the withdrawal of the roving will not be increased because the slideway moves in unison with the roving in the direction of withdrawal.

The desired result residing in that the protruding fiber ends are wound about the roving can desirably be utilized if that portion of the periphery of the delivery roller which constitutes the slideway has such a peripheral length that said slideway is contacted by the roving as far as to the point to which the roving is twisted. This means that the slideway must have a minimum peripheral length, which will depend on the friction conditions. To ensure that a slideway having that minimum peripheral length can be provided without difficulties in design, that delivery roller which is provided with the guiding surface may be correspondingly larger in diameter than the other delivery roller. A ratio of at least 1.5 to 2 of the diameters will be desirable in most cases.

In order to assist the twisting of the roving adjacent to the guiding surface, a further feature of the invention resides in that a pressure-applying roller for engaging the drawn roving is provided between the delivery end of the guiding surface for deflecting the drawn roving and the clamping nip between the two delivery rollers of the drawing frame, the delivery roller which constitutes the guiding surface is provided with a peripherally extending suction zone for sucking the drawn roving in the peripheral region between the nip and the pressure-applying roller, and blasting means for discharging an air blast against the delivery roller which is provided with the suction zone are provided adjacent to the suction zone and laterally outwardly spaced from at least one longitudinal side thereof, which air blast flows on said guiding surface toward said suction zone transversely to its longitudinal direction. Because blasting means are provided, which are laterally outwardly spaced from one longitudinal side of a suction zone between the clamping nip and a pressure-applying roller, which precedes and is spaced from the delivery end of the guiding surface, an air blast which flows on said guiding surface toward said suction zone transversely to the drawn roving can be directed against the drawn roving, which is retained on the guiding surface by the suction zone, and a highly effective bundling of the fibers will thus be effected. Because that bundling of the fibers is not effected in the high-draft field but behind that field when the roving has emerged from the clamping nip between the two delivery rollers, the roving will be maintained in the small width which has been obtained because the fibers of the wider roving strip have been moved toward each other. The pressure-applying roller, which engages the roving behind the blasting means, will ensure that the roving will be guided as is required so that the bundling of the fibers will substantially be assisted as the transverse force which is exerted by the air blast acts on the roving between two guides for the roving, which guides are constituted by the clamping nip between the two delivery rollers of the drawing frame and by the guiding nip between the pressure-applying roller and the one delivery roller.

The guiding nip defined by the pressure-applying roller differs from the clamping nip in that only guiding forces which prevent a lateral wandering are required in the former so that the bundled roving can emerge from that guiding nip may have an approximately square cross-sectional shape and, as a result, the subsequent twisting of the fibers will be simplified because the roving has no fibers which would extend laterally in a roving strip having a substantial width and would have to be moved toward each other in a triangular region to form a roving which is round in cross-section.

If two ring spinning mechanisms and a drawing frame having at least two draft paths for respective rovings are provided, particularly desirable conditions for the bundling of drawn rovings will be obtained if that delivery roller which constitutes the guiding surface for deflecting the rovings is provided with two suction zones, which are associated with respective rovings and disposed in the peripheral portion between the clamping nip and the pressure-applying roller, said suction zones define between them a substantially triangular surface, which flares in the feeding direction, and the blasting means discharge the air blast against said triangular surface. Because the blasting means are provided adjacent to the generally triangular surface between the suction zones, which diverge in the feeding direction, the air blast on each delivery roller will be divided into two partial streams, which flow in mutually opposite directions transversely to the drawn rovings. As a result, the rovings, which have only a small lateral spacing because the draft paths are closely juxtaposed, are blown apart so that their spacing is increased. As the rovings are retained on the delivery roller by the streams of air which are sucked by the suction zones at that time, the fibers will be very effectively bundled. Because the drawn rovings are urged laterally apart, the spacing of the rovings will be adjusted to match the spacing of the ring spinning mechanisms.

Because the rovings are bundled to have a cross-section which matches the cross-section of the yarn that is to be made, the roving can be more easily twisted by the traveler of the succeeding ring spinning mechanism. As a result, fine rovings made from carded preliminary rovings may be supplied to the drawing frame even if relatively fine yarns are to be made, which could only be made from combed preliminary rovings if the drawn fine rovings were not bundled as described.

BRIEF DESCRIPTION OF THE DRAWING

FIG. 5 is a side elevation, which is partly torn open and shows the apparatus of FIG. 4.

FIG. 6 is a top plan view showing that apparatus.

DETAILED DESCRIPTION OF THE PREFERRED EMBODIMENTS

Figure 1:
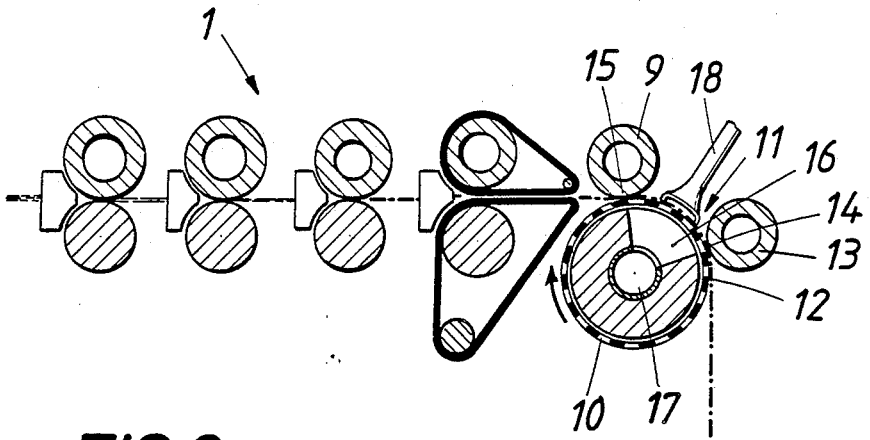
FIG. 1 is a diagrammatic side elevation, which is partly torn open and shows an apparatus for making a yarn in accordance with the invention.
Figure 2:
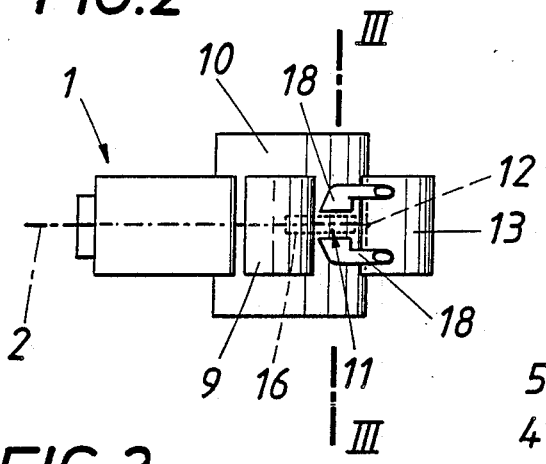
FIG. 2 is a fragmentary top plan view showing a portion of that apparatus adjacent to the pair of delivery rollers of the drawing frame.
Figure 2:
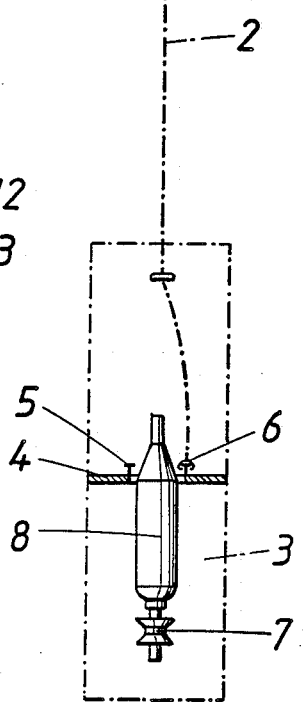
Figure 3:
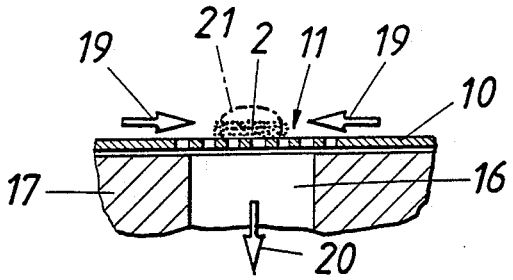
FIG. 3 is an enlarged sectional view taken on line III—III in FIG. 2.

In the embodiment shown by way of example in FIGS. 1 to 3, the apparatus essentially consists of a drawing frame 1 for drawing a roving 2 and a ring spinning mechanism 3, which is designed as usual and comprises a ring rail 4 that is provided with a ring 5, a traveler 6, which is movably mounted on the ring 5, and a bobbin 8, which is adapted to be driven by a whorl 7 on a spindle.

The drawing frame 1 comprises two delivery rollers 9 and 10. The lower delivery roller 10 constitutes a guiding surface 11 for deflecting the drawn roving 2. A pressure-applying roller 13 precedes and is spaced from the delivery end 12 of the guiding surface 11 and defines with the delivery roller 10 a nip 14 for guiding the roving 2. The drawn roving 2 enters the ring spinning mechanism 3 through an eyelet which causes the drawn roving to contact the delivery roller 10 on the guiding surface 11 beyond the pressure-applying roller 13 as far as to the delivery end 12. As the pressure-applying roller 13 precedes and is spaced from the delivery end 12 of the guiding surface 11 and the delivery roller 10 constitutes a slideway for guiding the roving 2 transversely to its axis, a twist is imparted to the roving 2 by the traveler 6 as far as to the guiding nip 14. Because a twist is thus imparted to the roving at the delivery end of the guiding surface 11, the protruding fiber ends are wound around the roving transversely to the latter so that the strength of the yarn will be increased.

The delivery roller 10 is provided between the clamping nip 15 and the pressure-applying roller 13 with a suction zone 16 for sucking the drawn roving 2. For that purpose the delivery roller 10 comprises a suitable suction insert 17. Two blasting devices 18 are provided, which are laterally outwardly spaced from respective longitudinal sides of that suction zone 16, which extends in the peripheral direction of the delivery roller 10. Each of said blasting devices 18 comprises a slot orifice, which extends approximately parallel to and faces the suction zone 16 and discharges an air blast, which flows at 19 on the guiding surface 11 in a direction which is transverse to the longitudinal direction of the suction zone 16, as is diagrammatically indicated in FIG. 3. Because the roving 2 is sucked against the delivery roller 10 by the sucked stream 20 adjacent to the suction zone 16 and is guided in the clamping nip 15 and in the guiding nip 14, the air blasts flowing at 19 will tend to bundle the fibers so that the roving having the cross-sectional shape shown on the drawing and having a substantial width may be transformed to a cross-sectional shape 21, which more closely approaches the cross-section of the yarn that is to be made. For this reason the fibers of the wide roving strip need not be moved toward each other to assume the round cross-section of the yarn in a triangular region as the fibers are twisted after the guiding nip 14 so that the alignment of the fibers will be improved and the strength of the yarn will thus be increased.

Figure 4:
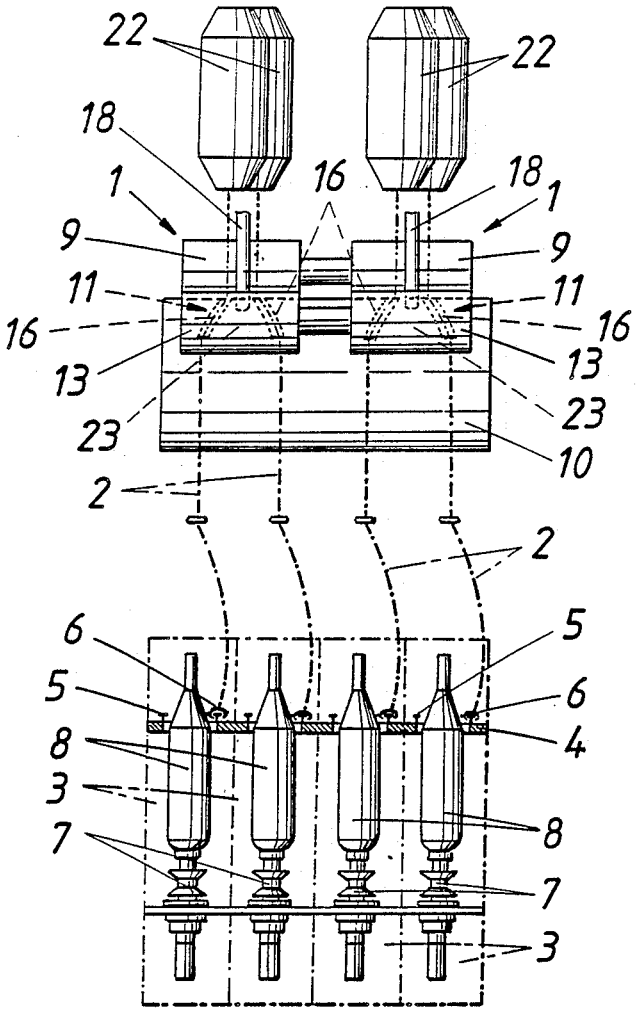
FIG. 4 is a diagrammatic front elevation showing a modified apparatus in accordance with the invention comprising two ring spinning mechanisms.

The embodiment shown by way of example in FIGS. 4 to 6 comprises four ring spinning mechanisms 3 and in association therewith two drawing frames 1, each of which comprises two draft paths for respective rovings 2. One roving is fed to each of the ring spinning mechanisms 3. Said rovings 2 are withdrawn as fine rovings from respective bobbins 22 and are fed in pairs to the two drawing frames 1 and drawn in a plurality or draft fields along the closely juxtaposed draft paths.

As is apparent from FIGS. 4 and 6, a common delivery roller 10 is associated with the two drawing frames 1 and cooperates with and is much larger in diameter than the delivery rollers 9. Behind the clamping nips 15 between the delivery rollers 9 and the delivery roller 10 the latter constitutes a guiding surface 11 for deflecting the drawn rovings 2. A pair of diverging suction zones 16 for sucking the rovings 2 are provided on the peripheral surface of the delivery roller 10 between each of the delivery rollers 9 and each pair of pressure-applying rollers 13, which succeed the delivery rollers in the feeding direction on the delivery roller 10. Suction is applied to said suction zones via a suction insert 17 of the delivery roller 10. It is apparent that a generally triangular surface 23, which flares in the feeding direction, is left between the two suction zones 16 which are associated with each drawing frame 1 and a blasting device 18 discharges an air blast against said triangular surface 23.

The rovings 2 which emerge from the clamping nip 15 between the delivery rollers 9 of each drawing frame 1 and the common delivery roller 10 have a small lateral spacing because the draft paths are closely juxtaposed. By the air blasts discharged by the blasting devices 18 the rovings 2 are blown apart so that their spacing is increased. As a result, said rovings are bundled further, particularly because the pressure-applying rollers 13 effectively restrict the lateral displacement of the rovings.

Because the rovings 2 are bundled in pairs owing to the cooperation of the blasting devices 18 and the suction zones 16, it is not necessary to move the fibers together in a triangular region to assume the round cross-section of the yarn as the fibers are twisted, as would otherwise be required during the twisting of a wider roving strip which has emerged from the high-draft field of the drawing frames 1. Besides, the guidance of the rovings on the delivery roller 10 beyond the pressure-applying rollers 13, which precede and are spaced from the points 12 at which the rovings 2 depart from the delivery roller 10, has the result that protruding roving fibers are wound on each roving because a twist is imparted to the rovings by the ring spinning mechanisms 3 as far as to the guiding nips 14 between the pressure-applying rollers 13 and the delivery roller 10 so that protruding fiber ends are wound on the rotating rovings 2 on the surface of the delivery roller 10.

I claim:

1. In an apparatus for making a yarn, comprising ring spinning means, drawing means defining at least one draft path and operable to draw at least one roving along said at least one draft path, said drawing means also comprising delivery roller means defining at least one clamping nip and operable to deliver at least one drawn roving from said at least one draft path through said at least one clamping nip to said ring spinning means, said delivery roller means comprising a deflecting delivery roller, which has a peripheral surface portion that extends from said at least one clamping nip to a delivery end remote from said at least one clamping nip, said apparatus further comprising means for contacting said at least one drawn roving with said peripheral surface portion from said at least one clamping nip to said delivery end so that said peripheral surface portion constitutes a guiding surface for deflecting said drawn roving on said deflecting delivery roller, the improvement residing in that said peripheral surface portion is formed with a slideway, which adjoins said delivery end and is arranged to guide said at least one drawn roving on said peripheral surface portion transversely to the axis of said drawn roving, at least one pressure-applying roller is provided to urge said at least one drawn roving against said peripheral surface portion at a distance from said delivery end, said peripheral surface portion is provided between said at least one clamping nip and said pressure-applying roller with at least one suction zone having two mutually opposite longitudinal sides extending in the peripheral direction of said delivery roller, and blasting means are provided, which are laterally outwardly spaced from at least one of said longitudinal sides of said at least one suction zone and are operable to discharge against said peripheral surface portion an air blast so that said air blast flows on said peripheral surface portion toward said suction zone transversely to said peripheral direction.

2. The improvement set forth in claim 1 wherein said ring spinning means comprise two juxtaposed ring spinning mechanisms for making respective yarns, said drawing means comprise two drawing frames, each of which defines two draft paths and is operable to draw two rovings along respective ones of said draft paths, said delivery roller means define two of said clamping nips and are operable to deliver two drawn rovings from respective ones of said draft paths through said clamping nips to respective ones of said ring spinning mechanisms, said peripheral surface portion is formed with two juxtaposed ones of said suction zones, said peripheral surface portion has between said two suction zones a generally triangular surface, which flares toward said pressure-applying roller and which is not provided with suction-exerting means, and said blasting means are operable to discharge said air blast against said generally triangular surface.

* * * * *